US006095841A

United States Patent [19]

Felps

[11] Patent Number: 6,095,841

[45] Date of Patent: Aug. 1, 2000

[54] PUSH-LOCK BNC CONNECTOR

[75] Inventor: Jimmie D. Felps, Colorado Springs, Colo.

[73] Assignee: Agilent Technologies, Palo Alto, Calif.

[21] Appl. No.: 09/045,600

[22] Filed: Mar. 20, 1998

Related U.S. Application Data

[62] Division of application No. 08/699,023, Aug. 16, 1996.

[51] Int. Cl.[7] ..... H01R 13/62

[52] U.S. Cl. ..... 439/312; 439/314

[58] Field of Search ..... 439/311, 312, 439/313, 314, 317

[56] References Cited

U.S. PATENT DOCUMENTS

| | | | |
|---|---|---|---|
| 4,708,661 | 11/1987 | Morland et al. | 439/77 |
| 5,067,909 | 11/1991 | Behning | 439/315 |

FOREIGN PATENT DOCUMENTS

| | | |
|---|---|---|
| 3042185A1 | 5/1981 | Germany . |
| 3248154C1 | 4/1984 | Germany . |
| 8814808 U1 | 2/1989 | Germany . |

OTHER PUBLICATIONS

Tajimi, BNCS series, "One Touch Push/Pull Locking BNC Coaxial RF Connector (50 Ω/75 Ω)/BNCS series" (undated).

Tajimi Electronics Co., Ltd., Data Sheet for BNCS502–P().

Stonewells Corporation, Data Sheet for BNCS502–P() (undated).

*Primary Examiner*—Paula Bradley
*Assistant Examiner*—Truc Nguyen

[57] ABSTRACT

A locking assembly for releasably locking together a mating connector pair comprises a housing having a central aperture therethrough and adapted to be mounted to the first connector portion of the mating connector pair. A locking sleeve also having a central aperture is sized to receive the first connector portion and is also sized to be slidably received by the central aperture of the housing so that the locking sleeve can be rotated within the housing from a locked position to an unlocked position. The locking sleeve also includes a locking pin engaging boss for releasably engaging a locking pin associated with the second connector portion of the mating connector pair. Specifically, the locking pin engaging boss rotates the locking sleeve to the unlocked position as the first connector portion is engaged with the second connector portion. The locking pin engaging boss also allows the locking sleeve to be rotated to the locked position when the first and second connector portions are fully engaged. A biasing device associated with the locking sleeve biases the locking sleeve to the locked position.

13 Claims, 6 Drawing Sheets

PUSH-LOCK BNC CONNECTOR

CROSS-REFERENCE TO RELATED APPLICATION

This is a division of co-pending U.S. patent application Ser. No. 08/699,023, filed on Aug. 16, 1996, which is incorporated herein by reference for all that it discloses.

FIELD OF INVENTION

This invention relates generally to the field of electrical connectors and more specifically to BNC connectors.

BACKGROUND

Various kinds of electrical connectors exist and have been used for decades to provide a removable electrical connection between various types of electrical components and devices. One such kind of removable electrical connector is known as a BNC or Bayonet Neil-Concelman connector. BNC connectors were developed many years ago and are typically used to connect coaxial (i.e., two conductor) cables, frequently in low-power, radio-frequency, and test applications, although they may be used in other applications as well.

Referring to FIG. 1, a typical BNC connector may comprise a female connector assembly 11 and a male connector assembly 13 that are designed to be engaged and disengaged with one another. The female connector assembly 11 includes a sleeve 15 that surrounds a female receptacle 21 designed to receive the center conductor 23 of the male connector assembly 13. The sleeve 15 also includes a pair of diametrically opposed engagement pins 17, 19 that extend radially outward from the sleeve 15. The male connector assembly 13 includes a male BNC center terminal 33 having a center conductor 23. The male center terminal 33 and conductor 23 are designed to be received by the sleeve 15 and female receptacle 21, respectively. The male connector assembly 13 also includes a locking collar 29 having a pair of slots 25, 27 that are adapted to engage the engagement pins 17, 19 on the female connector 11 to lock the connectors together.

The female and male connectors 11 and 13 can be connected and locked together by first engaging the male BNC center terminal 33 with the sleeve 15 and then rotating the locking collar 29 to the locked position. This twist-lock coupling action is a central feature of the BNC connector and allows a reliable electrical connection to be made without the danger of the female and male connectors 11 and 13 from gradually working loose or from becoming accidently unplugged.

While such twist-lock BNC connectors provide a convenient and reliable means for electrically connecting various electronic components and devices, they are not without their disadvantages. For example, in a conventional twist-lock BNC connector, sufficient space must be associated with the connector installation to allow the user's thumb and forefinger to push-on the male connector (e.g., 13) and then twist the locking collar (e.g., 29) to the locked position. If the BNC connector is aged or dirty, excessive friction between the locking collar and the body of the male center terminal (e.g., 33) or the sleeve (e.g., 15) of the female connector (e.g., 11) may make it difficult to twist the locking collar to the locked position, particularly if other connectors or components are located nearby. Another problem is that there is no guaranteed radial alignment between the locking collar and the cable (e.g., 31) or probe housing to which it is attached. That is, since the collar on the male connector portion is free to rotate 360°, no specific rotational alignment is guaranteed between the cable or probe housing and the panel to which it is attached. This can be a problem if the male BNC connector is associated with an "active" probe assembly having associated with it supplemental connectors (e.g., power or communication connectors) that need to be aligned with corresponding mating connectors adjacent the female BNC connector.

Consequently, a need exists for an improved connector which solves or at least ameliorates some of the problems associated with conventional twist-lock BNC connectors, but that retains the advantages associated with such connectors. Ideally, such an improved connector should retain the ability to be locked to the female portion of the connector, but without requiring excessive manual dexterity on the part of the user and without requiring a large amount of space between the BNC connector and adjacent connectors or components. Additional utility could be achieved if the improved BNC connector could be used with conventional female BNC connectors. Still other advantages could be realized if such an improved connector would provide for a guaranteed radial alignment between the panel and the attached cable or pod housing.

SUMMARY OF THE INVENTION

Accordingly, a locking assembly for releasably locking together a mating connector pair according to the present invention may comprise a housing having a central aperture and configured to be mounted to the first connector portion of the mating connector pair. A locking sleeve also having a central aperture is sized to receive the first connector portion and is also sized to be slidably received by the central aperture of the housing so that the locking sleeve can be rotated within the housing from a locked position to an unlocked position. The locking sleeve also includes a locking pin engaging boss for releasably engaging a locking pin associated with the second connector portion of the mating connector pair. Specifically, the locking pin engaging boss rotates the locking sleeve to the disengaged position as the first connector portion is engaged with the second connector portion. The locking pin engaging boss also allows the locking sleeve to be rotated to the locked position when the first and second connector portions are fully engaged. A biasing device associated with the locking sleeve biases the locking sleeve to the locked position.

Also disclosed is a push-lock connector assembly for releasably locking together a mating BNC connector pair. The push-lock connector comprises a male BNC center terminal and a housing sized to receive the male BNC center terminal. The housing also includes a substantially circular opening at one end that is sized to receive the sleeve associated with the female BNC connector. The circular opening also includes a pair of alignment notches positioned at substantially diametrically opposed positions to receive the locking pins located on the sleeve of the female BNC connector. A locking sleeve having a central aperture is sized to be received by the housing so that the central aperture of the locking sleeve is substantially aligned with the circular opening in the housing. The locking sleeve is also sized so that it can be rotated within the housing from a locked position to an unlocked position. The locking sleeve includes a pair of locking pin engaging bosses positioned within the central aperture at substantially diametrically opposed positions. The pair of locking pin engaging bosses cause the locking sleeve to rotate to the disengaged position as the push-lock connector assembly is moved axially along the sleeve of the female BNC connector. They also allow the locking sleeve to be rotated to the locked position when the male BNC center terminal is fully engaged with the female BNC connector. A biasing device associated with the locking sleeve biases said locking sleeve to the locked position.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
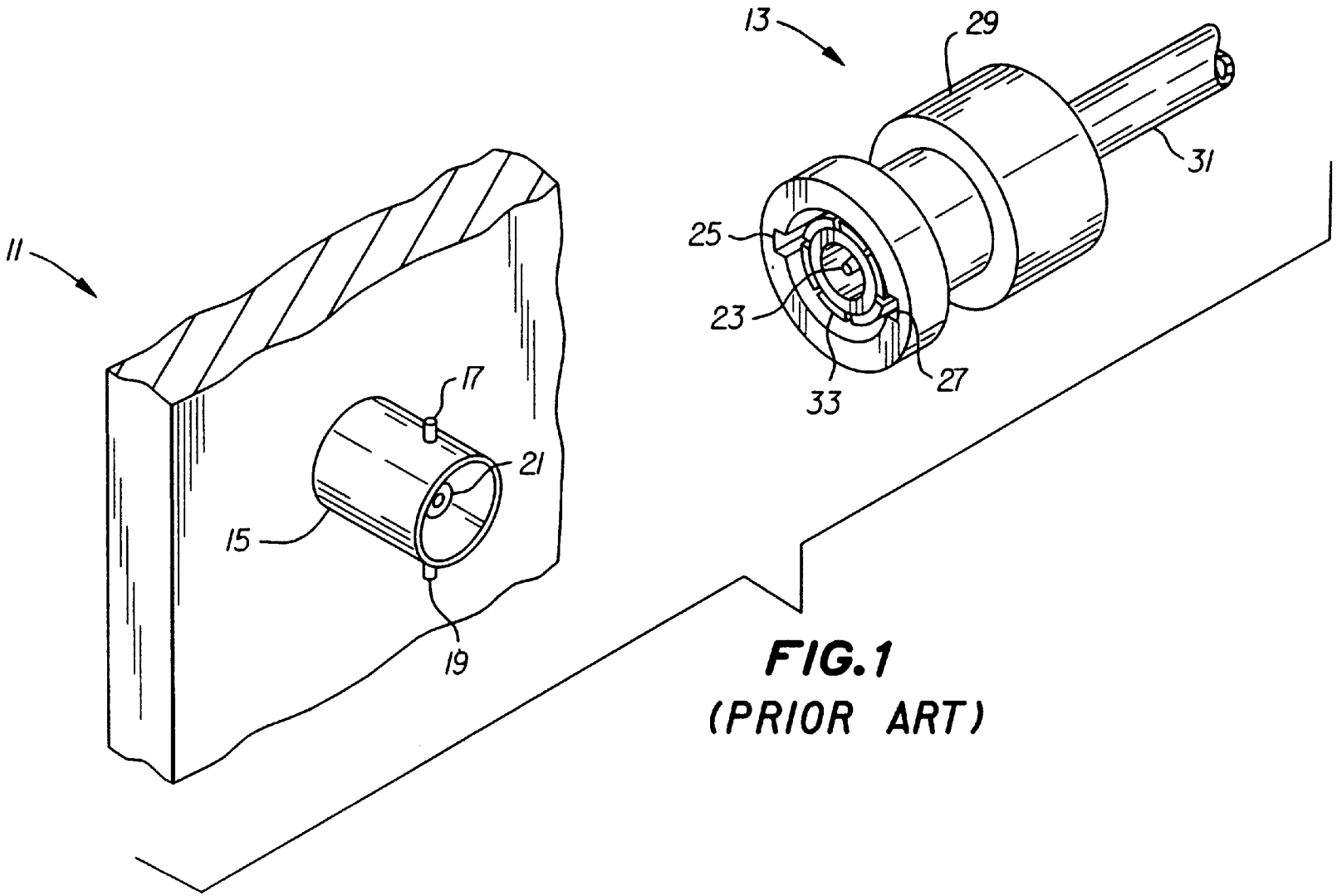
FIG. 1 (PRIOR ART)
FIG. 1 is a perspective view of a conventional male and female BNC connector pair.
Figure 2:
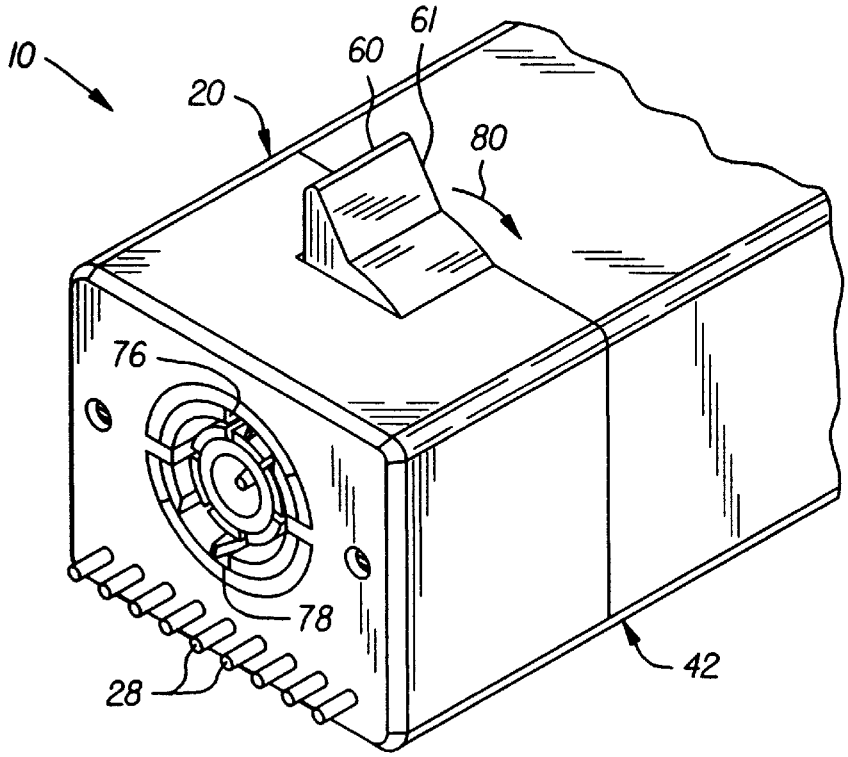
FIG. 2 is a perspective view of a male push-lock BNC connector according to the present invention having a plurality of optional contact pins for transmitting supplemental electrical currents or signals through the connector.
Figure 3:
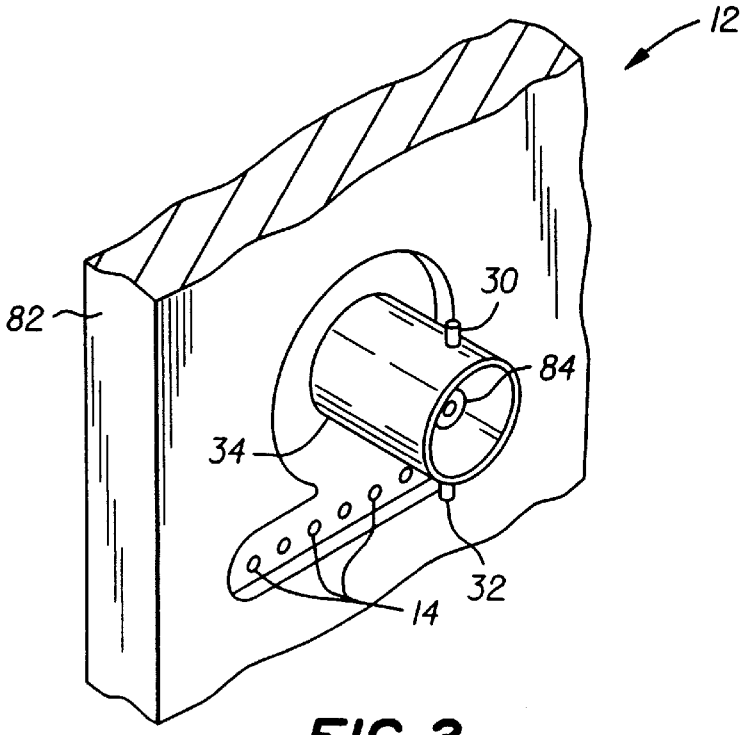
FIG. 3 is a perspective view of a female BNC connector assembly also having a plurality of optional contact pads for transmitting supplemental electrical currents or signals through the connector.
Figure 4:
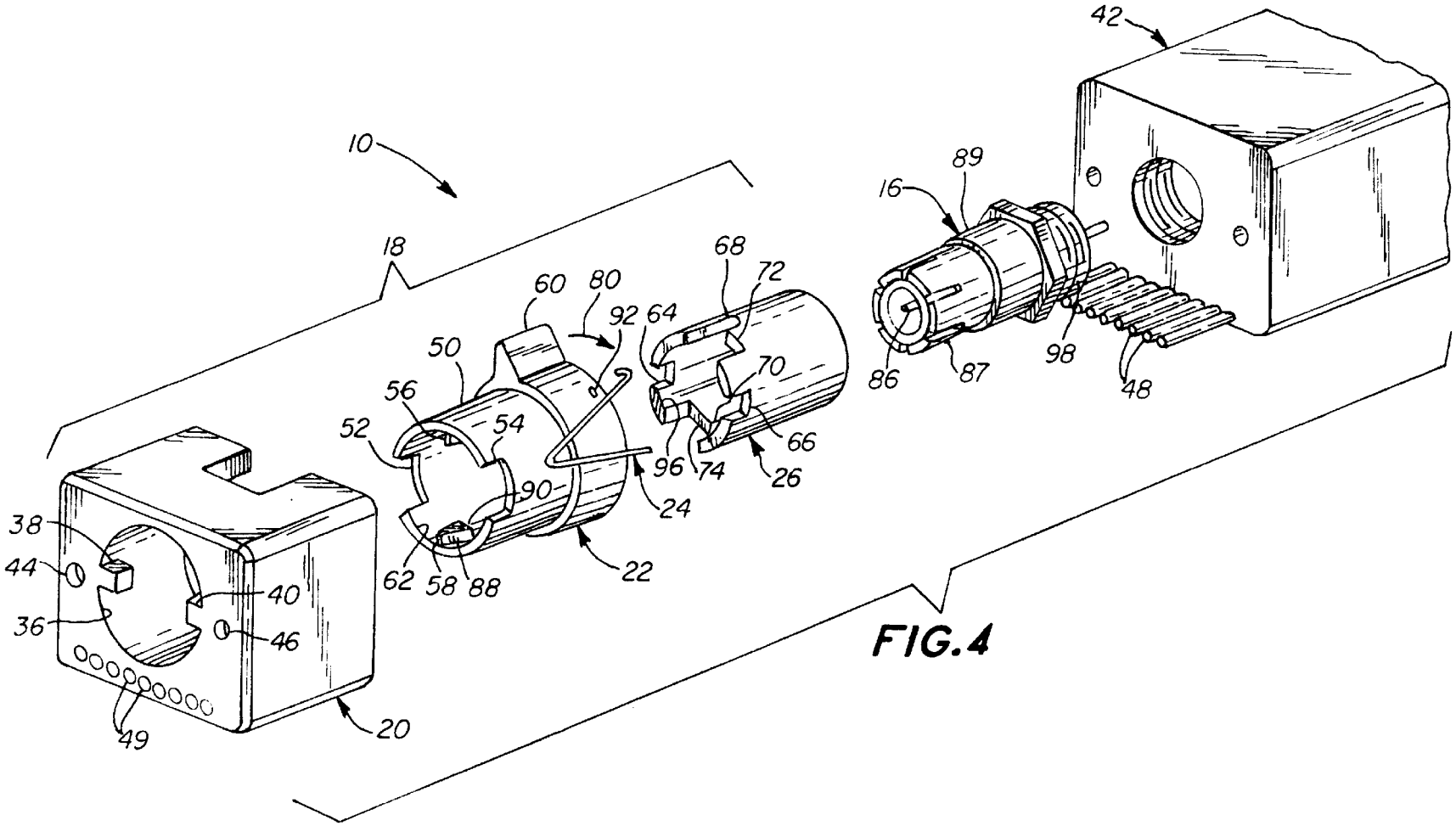
FIG. 4 is an exploded perspective view of the male push-lock BNC connector shown in FIG. 2 more clearly showing the arrangement of the locking sleeve, the alignment sleeve, and the male BNC center terminal.

A push-lock BNC connector 10 according to the present invention is best seen in FIGS. 2 and 4 as it could be used to connect with a female BNC connector portion 12 shown in FIG. 3. In one preferred embodiment, the push-lock BNC connector 10 includes a plurality of contact pins 28 for making electrical contact with a plurality of corresponding contact pads 14 positioned adjacent the female BNC connector 12. The pins 28 and contact pads 14 allow for the transmission of supplemental electrical signals through the connector union, such as may be required for "active" probe assemblies, i.e., probe assemblies having on-board electronic circuitry. Alternatively, and as will be described in greater detail below, the push-lock BNC connector 10 could also be used to connect with a conventional female BNC connector without such optional contact pads 14, such as the female BNC connector 11 shown in FIG. 1.

Referring now specifically to FIG. 4, the push-lock BNC connector 10 essentially comprises a male BNC center terminal or connector portion 16 and a locking assembly 18 which allows the male BNC center terminal 16 to be engaged with and locked to the female BNC connector 12 (FIG. 3) by simply pushing the push-lock connector 10 onto the female connector 12. There is no need to rotate any locking collar to engage the locking pins 30, 32 on the sleeve 34 of female connector 12. The connectors 10 and 12 can be uncoupled by simply moving the tab 60 on the locking collar 22 (sometimes referred to herein as a lock sleeve) to the unlocked position 61' (FIG. 6) i.e., in the direction of arrow 80.

The locking assembly 18 in one preferred embodiment may comprise a housing 20, a locking sleeve 22, a spring 24, and an alignment sleeve 26. The housing 20 has a central aperture 36 therethrough as well as a pair of alignment tabs 38, 40 for engaging corresponding slots 64, 66 on the alignment sleeve 26. The housing 20 may be secured to a main connector body 42 of an active probe assembly (not shown) by any convenient means, such as by a pair of screws 44, 46. The housing 20 may also include a plurality of holes 49 for receiving a corresponding plurality of connector pin sockets 48 mounted to the main connector body 42.

Figure 6:
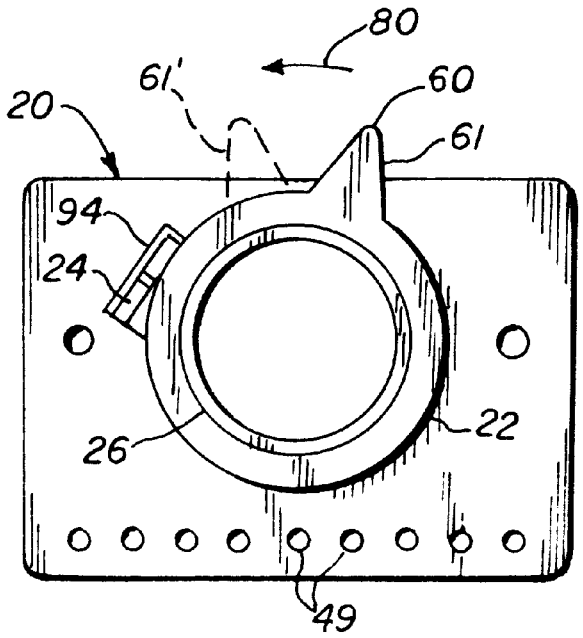
FIG. 6 is a rear view in elevation of the housing showing the arrangement of the locking sleeve and spring.

The locking collar 22 is sized to be received by the central aperture 36 of housing 20 so that the locking collar 22 can be rotated within the housing 20 between a locked position 61 and an unlocked position 61', as best seen in FIG. 6. In one embodiment, the locking collar 22 includes an elongate, cylindrically shaped body portion 50 having a pair of substantially diametrically opposed slots 52, 54, along with a pair of locking pin engaging bosses 56, 58. Locking collar 22 may also include an integral tab 60 to allow the user to rotate the locking collar 22 to the unlocked position 61' by moving the tab 60 in the direction of arrow 80. A spring 24 connected to the locking collar 22 biases the locking collar 22 to the locked position 61.

Locking assembly 18 also includes an alignment sleeve 26 sized to be received by the central aperture 62 of the locking sleeve 22. The alignment sleeve 26 includes a pair of substantially diametrically opposed slots 64 and 66 for engaging the respective alignment tabs 38 and 40 of the housing 20. It also includes a pair of indexing slots 68 and 70 for receiving the locking pins 30 and 32 located on the sleeve 34 of female connector portion 12 (FIG. 3). Indexing slots 68 and 70 also include a pair of clearance slots 72 and 74 to provide clearance for the respective locking pin engaging bosses 56, 58 on the locking sleeve 22. The alignment sleeve 26 is also sized to slide over the male BNC center terminal 16, which itself may be secured to the main connector body 42 by any convenient means, such as by screw threads 98.

Figure 7:
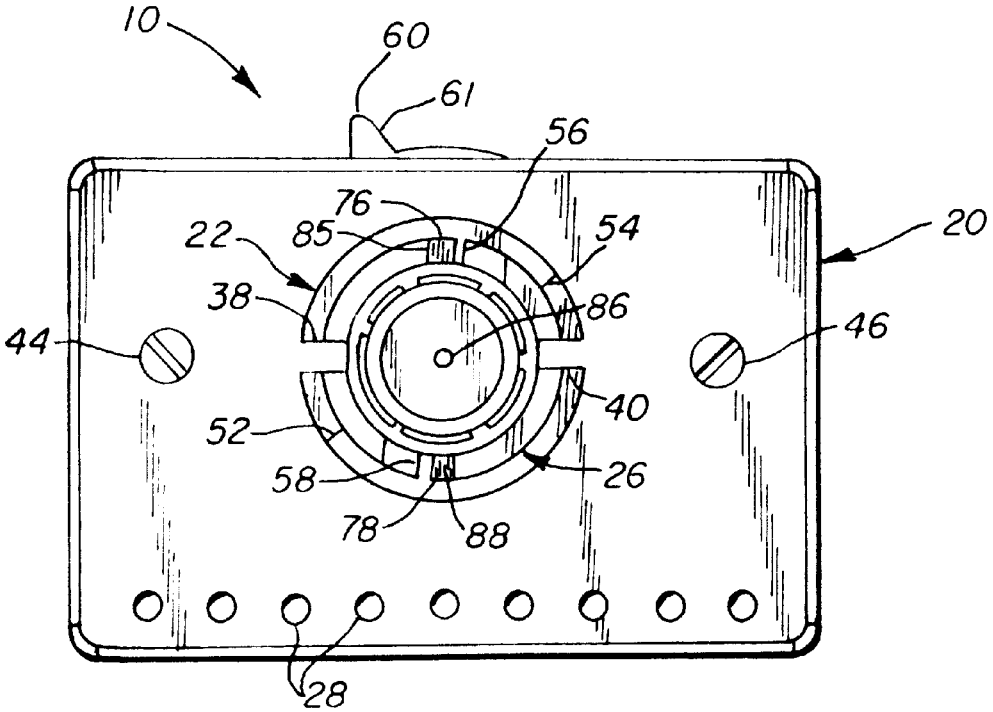
FIG. 7 is a front view in elevation of the housing showing the arrangement of the locking sleeve and alignment sleeve.

The locking assembly 18 thus provides a means for lockably engaging the male BNC center terminal 16 to a conventional female BNC connector, such as the female connector portion 12 shown in FIG. 3. The engagement procedure is relatively simple, requiring only that the push-lock BNC connector assembly 10 be aligned with the sleeve 34 of the female connector portion 12. More specifically, the connectors should be aligned so that the locking pins 30 and 32 are aligned with the engagement slots 76, 78 (FIGS. 2 and 7) defined between indexing slots 68, 70 of the alignment sleeve 26 and the locking pin engaging bosses 56, 58. The connectors can then be engaged by simply pushing the connector 10 over the female connector 12. As the connector 10 moves along the sleeve 34 of the female connector 12, the locking pins 30, 32 engage the bosses 56, 58, which causes the locking sleeve 22 to rotate to the unlocked position 61' (FIG. 6). Once the connector 10 is fully engaged, the spring 24 returns the locking sleeve 22 to the locked position 61. The connector assembly 10 is then in locked engagement with the female connector portion 12.

The push-lock BNC connector can be disengaged by simply moving the tab 60 in the direction of arrow 80 which rotates the locking sleeve 22 to the unlocked position 61' (FIG. 6) and disengages the bosses 56 and 58 from the locking pins 30, 32. The connector 10 may then be withdrawn from the female connector portion 12.

A significant advantage of the push-lock BNC connector 10 according to the present invention is that it can be engaged with a female BNC connector without the need to manually rotate a locking collar to engage the locking pins on the female BNC connector. Instead, the two connectors can be engaged by simply pushing together the two connector portions 10 and 12. The connectors can be disengaged by simply moving the tab 60 in the direction of arrow 80 which rotates the locking sleeve 22 to the unlocked position 61'. The connector 10 can then be pulled away from the female connector portion 12. Consequently, the push-lock BNC connector does not require a significant amount of manual dexterity on the part of the user. Another advantage is that the connector 10 can be more easily used in installations where there would otherwise be insufficient clearance to allow the user to manually rotate the locking collar of a conventional BNC connector.

Still other advantages are associated with the alignment sleeve 26. For example, the alignment sleeve 26 provides a positive rotational index between the connector 10 and the female connector portion 12 before the connectors are engaged, thereby allowing any supplemental electrical connectors, such as contact pins 28, to be aligned without the need for a separate indexing system. Similarly, when the connector 10 is fully engaged and in the locked position, the alignment sleeve 26 prevents the connector 10 from rotating, thereby allowing a simple pin/contact pad arrangement to be used to transmit supplemental electrical signals through the connector.

Having briefly described the push-lock BNC connector 10, as well as some of its more significant features and advantages, the push-lock BNC connector according to the present invention will now be described in detail.

Referring back now to FIGS. 2, 3, and 4, the push-lock BNC connector 10 is shown as it could be used with an "active" probe assembly of the type commonly used with electronic test equipment (not shown), such as oscilloscopes or logic testers. In such an application, the push-lock BNC connector 10 may be incorporated into the main connector body 42 of the active probe assembly in the manner best seen in FIG. 4. The electronic circuitry (not shown) associated with the active probe assembly may be connected to the electronic test equipment (not shown) associated with the female connector portion 12 by a plurality of electrically conductive pins 28 which make electrical contact with a plurality of corresponding contact pads 14 associated with the female connector portion 12 (FIG. 3). The pins 28 and contact pads 14 allow for the transmission of the supplemental electrical signals required to operate the active probe assembly. However, it should be understood that the use of such additional electrical connectors, such as pins 28 and contact pads 14, are not required to achieve the objects of this invention and the push-lock BNC connector could be used just as easily with conventional plain female BNC connectors, such as the female connector 11 shown in FIG. 1.

Figure 5:
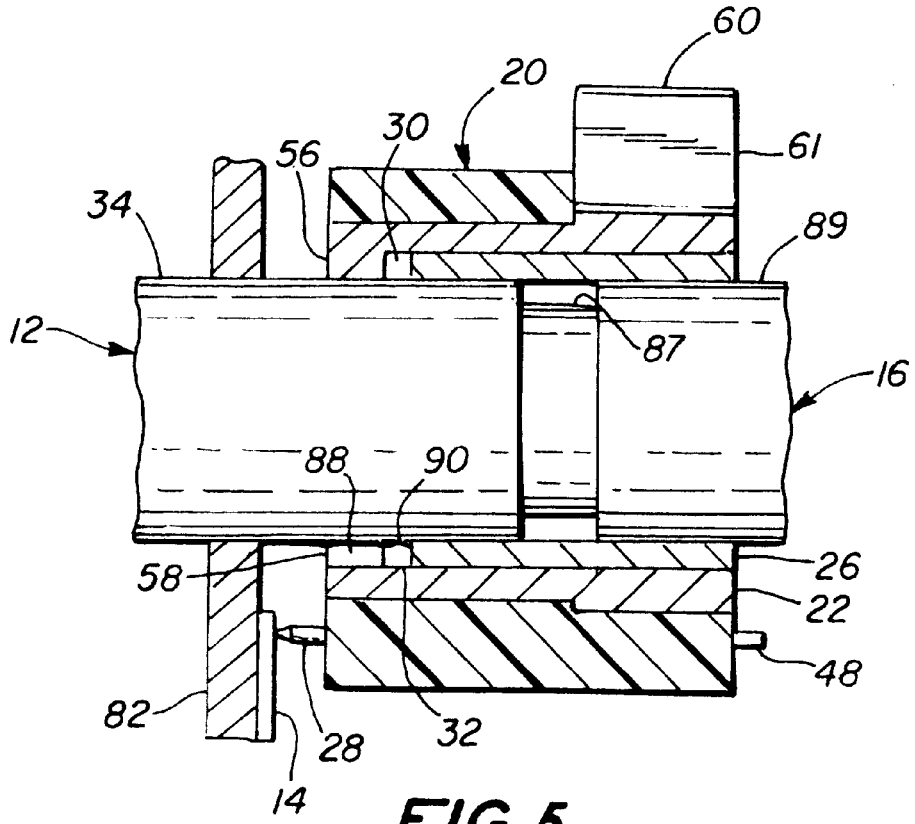
FIG. 5 is a sectional view in elevation showing the engagement of the male push-lock BNC connector with a female BNC connector assembly.

The female connector portion 12 is best seen in FIG. 3 as it could comprise part of a front panel assembly 82 of an oscilloscope, logic tester, or other type of electronic device (not shown). The female connector portion 12 is of the conventional configuration and includes a female receptacle 84 adapted to receive the center conductor 86 (FIGS. 4, 7) of the male BNC center terminal 16. A sleeve 34 surrounds the female receptacle 84 and makes electrical contact with the outer conductor 87 of the male BNC center terminal 16. The sleeve 34 also includes a pair of locking pins 30 and 32 positioned in substantially diametrically opposed relation as best seen in FIGS. 3 and 5. Depending on the application, the female connector portion 12 may also include a plurality of contact pads 14 for making electrical contact with the pins 28 contained on the push-lock connector assembly 10. Such an arrangement will allow for the transmission of supplemental electrical signals through the connector 10, such as may be required for the operation of active probe assemblies. In one preferred embodiment, the contact pads 14 may comprise part of a flexible printed wiring board (not shown) of the type well-known in the art. However, other devices exist and could be substituted for the contact pad/pin arrangement shown and described herein without departing from the spirit and scope of the present invention.

The details of the push-lock BNC connector assembly 10 are best seen in FIG. 4 with occasional reference to FIGS. 2 and 5–7. Essentially, the push-lock BNC connector assembly 10 comprises a conventional male BNC center terminal 16 and a locking assembly 18 which may be mounted to the main connector body 42 of an active probe assembly. The male BNC center terminal 16 may be mounted to the main connector body 42 of the active probe assembly by any convenient means, such as by screw threads 98 and may be electrically connected to the electronic circuitry (not shown) contained within the main connector body 42 in the conventional manner. Electrical power and/or other electronic data signals may be provided to/from the electronic circuitry (not shown) contained in the main connector body 42 by the plurality of contact pins 28 (FIG. 2). In one preferred embodiment, the contact pins 28 are removable and are slidably received by corresponding contact pin sockets 48 which extend from the main connector body 42. The contact pin sockets 48 are in turn connected to the electronic circuitry (not shown) mounted within the main connector body 42. The particular type of contact pins 28 and contact pin sockets 48 that may be used with the present invention are not critical and any of a number of commercially available contact pin/socket assemblies may be used without departing from the present invention. By way of example, one preferred embodiment utilizes a plurality of spring-loaded or "pogo" contact pins 28 and corresponding socket assemblies 48 available as respective model nos. S-2-J-4-G and R-2-R-P from Interconnect Devices, Inc., of Kansas City, Kans., although other types of pins and/or pin socket assemblies could also be used.

The locking assembly 18 comprises a housing 20, a locking sleeve 22, a spring 24, and an alignment sleeve 26. The arrangement is such that the housing 20 receives locking sleeve 22, which in turn receives the alignment sleeve 26. The entire locking assembly 18 fits over the outer sleeve 89 of the male BNC center terminal 16, as best seen in FIG. 5. In one preferred embodiment, the housing 20 is generally rectangular in shape, although other configurations are possible, and includes a central bore 36 therethrough sized to receive the cylindrical body portion 50 of locking sleeve 22. The central bore 36 also includes a pair of alignment tabs 38 and 40 positioned in generally diametrically opposed relation, as best seen in FIG. 4. Housing 20 may be secured to the main connector body 42 of the active probe assembly (not shown) by any convenient fastener system, such as by a pair of screws 44, 46. If it is desired to provide the connector assembly 10 with supplemental electrical conductors, such as a plurality of contact pins 28 (FIG. 2), the housing 20 should also include a plurality of holes 49 (FIG. 4) sized and spaced to receive the contact pin sockets 48 that extend from the main connector body 42.

The housing assembly 20 may be made from any of a wide variety of materials, such as metals or plastics, suitable for the intended application. In one preferred embodiment, the housing assembly 20 is molded as single piece from ABS plastic, although other materials could also be used, as would be obvious to persons having ordinary skill in the art.

The locking sleeve 22 comprises an elongate, cylindrically shaped body portion 50 having a central bore 62 therethrough adapted to slidably receive the alignment sleeve 26. See FIGS. 4 and 5. The body portion 50 includes a pair of slots 52, 54 for engaging the alignment tabs 38 and 40 on the housing 20. The slots 52 and 54 are wider than the alignment tabs 38 and 40 so that the locking sleeve 22 can be rotated between the locked position 61 and the unlocked position 61'. See FIGS. 6 and 7.

Locking sleeve 22 also includes a pair of locking pin engaging bosses 56 and 58 that engage the locking pins 30 and 32 on the sleeve 34 of female connector portion 12. See FIGS. 3 and 5. The bosses 56 and 58 are essentially identical and are located at substantially diametrically opposed positions within the central bore 62 so that they will engage the respective locking pins 30 and 32 on the sleeve 34 of the female connector assembly 12.

Referring now specifically now to FIG. 4 and to boss 58, boss 58 includes an inclined ramp section 88 which terminates at an essentially transverse pin stop section 90. Boss 56 is in every way identical to boss 58 and includes a ramp section 85 (FIG. 7) which terminates at a transverse pin stop (not shown). Bosses 56 and 58 are mirror images of one another so that the pins 30, 32 on the female connector assembly 12 engage the respective ramp sections (e.g., 88, 85) as the locking sleeve 22 slides over the sleeve 34 of the female connector portion 12. As will be described in greater detail below, the engagement of the locking pins 30, 32 with the ramp sections (e.g., 88, 85) of the respective bosses 56, 58 causes the locking sleeve 22 to rotate in the direction of arrow 80 to the unlocked position 61' (FIG. 6) as the connector assembly 10 is moved over the sleeve 34 of female connector portion 12. When the connectors are fully engaged, the locking pins 30, 32 of the sleeve 34 of female connector 12 are engaged with the transverse pin stops (e.g., 90) of the respective locking pin engaging bosses 56, 58. See FIG. 5. The locking sleeve 22 also includes an integral tab 60 to allow the user (not shown) to release a locked connector assembly by moving the tab 60 in the direction of arrow 80 which rotates the locking sleeve 22 to the unlocked position 61'. See FIG. 6.

The locking sleeve 22 may be made from any of a wide variety of materials, such as metals or plastics, that would be suitable for the intended application. In one preferred embodiment, the locking sleeve is made from a single piece of stainless steel, although other materials could also be used, as would be obvious to persons having ordinary skill in the art.

The locking sleeve 22 is biased in the locked position 61 (FIG. 6) by a spring 24 which engages a small hole 92 in the locking sleeve 22. See FIG. 4. The spring 24 fits within a recess 94 in housing 20, as is best seen in FIG. 6. The spring 24 thus biases the locking sleeve in the locked position 61. It should be noted that a wide range of springs and other biasing devices well-known in the art could be used to bias the locking sleeve 22 in the locked position 61, as would be obvious to persons having ordinary skill in the art. Therefore, the present invention should not be regarded as limited to any one particular spring arrangement for biasing the locking sleeve 22 to the locked position 61.

Referring back now to FIG. 4, the alignment sleeve 26 is generally cylindrically shaped and includes a central bore 96 therethrough that is sized to receive the male BNC center terminal 16. The alignment sleeve 26 provides a defined rotational alignment for the connector portion 10 with respect to the female connector portion 12 and also prevents the connector assembly 10 from rotating on the female connector portion 12 once it is fully engaged and locked. Consequently, the push-lock BNC connector assembly 10 can accommodate the pin 28 and pad 14 arrangement (FIGS. 2 and 3) without the need for a separate indexing device to ensure that the various pins 28 contact the proper contact pads 14.

Still referring to FIG. 4, the alignment sleeve 26 includes a pair of notches 64 and 66 that engage the respective alignment tabs 38 and 40 of the housing 20. The engagement of the notches 64, 66 with the tabs 38, 40 prevents the alignment sleeve 26 from rotating with respect to the housing 20. Alignment sleeve 26 also includes a pair of indexing slots 68 and 70 for engaging the locking pins 30, 32 on the sleeve 34 of the female connector portion 12. A pair of clearance slots 72, 74 provide clearance for the locking pin engaging bosses 56, 58 on the locking sleeve 22 and allow the locking sleeve 22 to rotate between the locked position 61 and the unlocked position 61' (FIG. 6).

As was the case for the locking sleeve 22, the alignment sleeve 26 may be made from any of a wide range of materials that would be suitable for the expected application and environment. In one preferred embodiment, the alignment sleeve 26 is made from a single piece of stainless steel, although other materials, such as plastic, could also be used.

The entire locking assembly 18, comprising the housing 20, locking sleeve 22, spring 24, and alignment sleeve 26, fits over the sleeve 89 of male BNC center terminal 16, as best seen in FIG. 5, and provides the male BNC center terminal 16 with a push-lock engagement with the female BNC connector assembly 12 (FIG. 3). In order to engage the connector assembly 10 with the female BNC connector assembly 12, the user (not shown) would first align the engagement slots 76, 78 (i.e., the slots defined between the engaging bosses 56, 58 and the indexing slots 68, 70) with the locking pins 30, 32 of the female connector 12. See FIGS. 2 and 7. This alignment defines the rotational alignment between the connector assembly 10 and the female connector portion 12. Having so aligned the connectors, the operator would then push the connector assembly 10 over the sleeve 34 of the female connector 12. As this is done, the locking pins 30, 32 engage the ramp sections (e.g., 88, 85) of the respective locking pin engaging bosses 56, 58, which causes the locking sleeve 22 to rotate in the direction of arrow 80 against the pressure exerted by spring 24 (i.e., toward the unlocked position 61'). When the connector 10 is fully inserted on the female connector portion 12, the locking pins 30, 32 clear the ramp sections (e.g., 88, 85) of the bosses 56, 58, at which time the pressure exerted by spring 24 returns the locking sleeve 22 to the locked position 61 (FIGS. 5 and 6). The locking pins 30, 32 are now engaged with the transverse pin stops (e.g., 90) of the bosses 56, 58, and securely hold the connector 10 in engagement with the female connector portion 12. The pins 30, 32 are also fully engaged with the indexing slots 68, 70 in the alignment sleeve 26, and prevent the connector 10 from rotating about the female connector portion 12.

Figure 9:
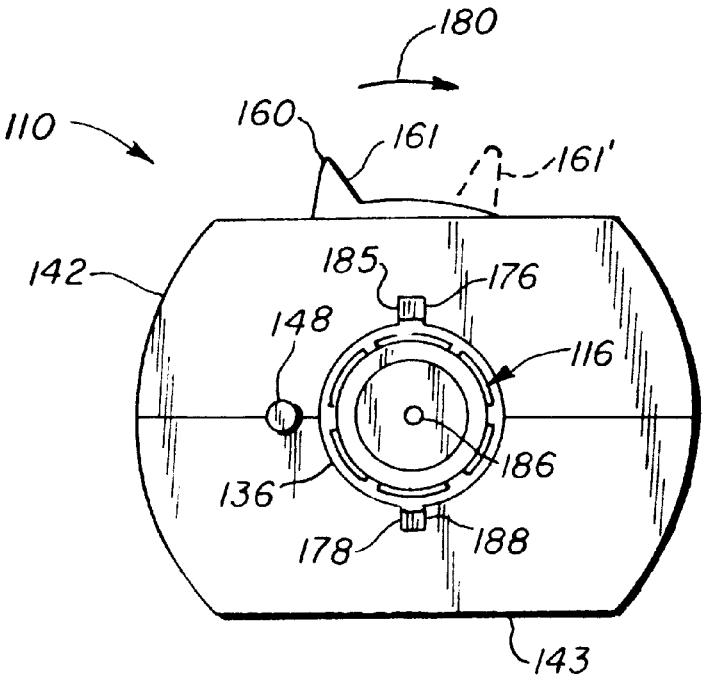
FIG. 9 is a front view in elevation of the push-lock BNC connector shown in FIG. 8.
Figure 8:
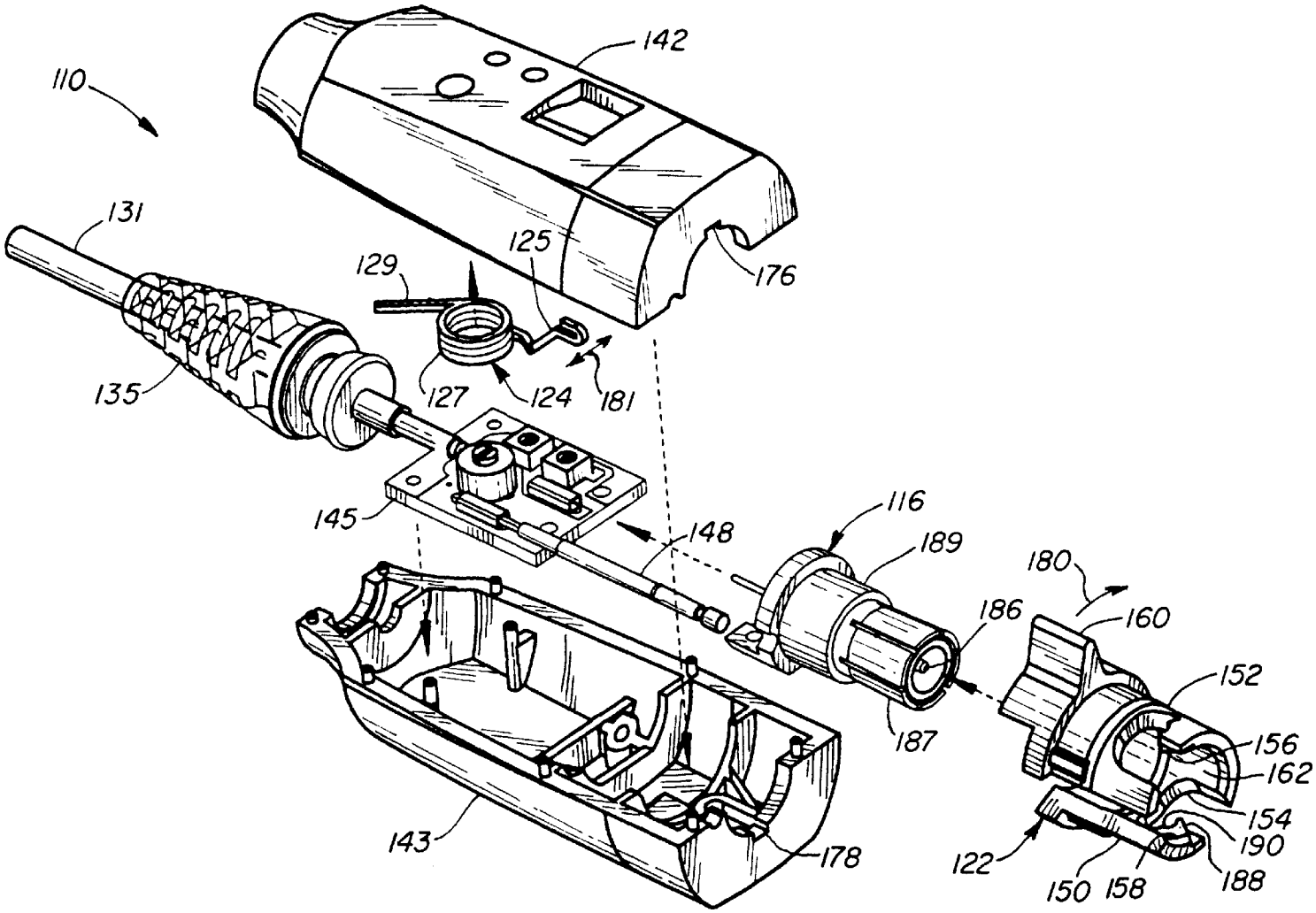
FIG. 8 is an exploded perspective view of another embodiment of the male push-lock BNC connector according to the present invention.

A second embodiment 110 of the push-lock BNC connector assembly according to the present invention is shown in FIGS. 8 and 9. The main difference between the second embodiment 110 and the first embodiment 10 is that the second embodiment 110 does not include a separate alignment sleeve, such as alignment sleeve 26 used in the first embodiment 10. Instead, the alignment function in the second embodiment 110 is provided by the two main connector body halves 142, 143. That is, when assembled, each main connector body half 142, 143 defines a circular opening 136 (FIG. 9) which includes a pair of alignment notches 176, 178 for engaging the locking pins 30, 32 on the female BNC connector assembly 12 (FIG. 3). The push-lock engagement feature is the same for the second embodiment 110, and the connector 110 can be engaged with the female connector assembly 12 by simply sliding it over the female connector assembly 12 until it is fully engaged, at which point the locking sleeve 122 will spring back to the locked position 161. The connector 110 can then be disengaged or removed from the female connector 12 by simply moving the releasing tab 160 to the unlocked position 161' and then sliding the connector 110 away from the female connector portion 12.

The details of the second embodiment 110 of the push-lock BNC connector are best seen in FIG. 8, with occasional reference to FIG. 9. Essentially, the connector 110 includes two main connector body halves 142, 143 for housing a PC board assembly 145, a male BNC center terminal 116, the locking sleeve 122, and a return spring 124. In one preferred embodiment, the two main connector body halves 142, 143 are also adapted to engage a strain relief section 135 associated with cable 131. The connector assembly 110 may also include an elongate contact pin socket 148 for receiving a contact pin (not shown in FIG. 8), such as contact pin 28 used in the first embodiment 10. See FIG. 2. As was the case for the first embodiment 10, the elongate contact pin socket 148, along with a suitable contact pin (not shown), such as contact pin 28, may be used to electrically connect the PC board assembly 145 to the instrument (not shown) associated with the female BNC connector assembly 12 for the purposes of providing a supplemental electrical current or signal. By way of example, such a supplemental electrical signal could comprise a probe identification signal to allow the instrument (not shown) associated with the female connector 12 to calibrate itself with respect to the particular probe being used. Since such probe identification functions are well-known in the art, the probe pin and PC board assembly 145 associated with the second embodiment 110 will not be described in further detail.

In one preferred embodiment, the two halves 142, 143 of the main connector body may be molded from ABS/PC plastic, although other materials could also be used, as would be obvious to persons having ordinary skill in the art.

The male BNC center terminal 116 is essentially identical to the male connector assembly 16, and includes a center conductor 186 surrounded by an outer conductor sleeve 187 which itself is surrounded by outer sleeve 189. The male BNC center terminal 116 may be connected to the PC board assembly 145 by any number of well-known means, such as by connectors or by solder, and may be secured within the two halves 142, 143 of the main connector body by appropriate support members integral with the two halves 142, 143.

The locking sleeve 122 differs somewhat from the locking sleeve 22 associated with the first embodiment 10. Still referring to FIG. 8, the locking sleeve 122 comprises an elongate cylindrical body section 150 having a central bore 162 therethrough adapted to receive the BNC center terminal 116. The body portion 150 includes a pair of slots 152, 154 for engaging the pins 30, 32 on the sleeve 34 of the female connector portion 12 (FIG. 3). The slots 152 and 154 also allow the locking sleeve 122 to be rotated between the locked position 161 and the unlocked position 161'. See FIG. 9.

Locking sleeve 122 also includes a pair of locking pin engaging bosses 156 and 158 that engage the locking pins 30 and 32 on the sleeve 34 of female connector portion 12. The bosses 156 and 158 are essentially identical and are located at substantially diametrically opposed positions within the central bore 162 so that they will engage the respective locking pins 30 and 32 on the sleeve 34 of the female connector assembly 12.

Referring now specifically now to FIG. 8 and to boss 158, boss 158 includes an inclined ramp section 188 which terminates at an essentially transverse pin stop 190. Boss 156 is in every way identical to boss 158 and includes a ramp section 185 (FIG. 9) which terminates at a transverse pin stop (not shown). As was the case in the first embodiment 10, bosses 156 and 158 are also mirror images of one another so that the pins 30, 32 on the female connector assembly 12 engage the respective ramp sections (e.g., 188, 185) as the locking sleeve 122 slides over the sleeve 34 of the female connector portion 12. The engagement of the locking pins 30, 32 with the ramp sections (e.g., 188, 185) of the respective bosses 156, 158 causes the locking sleeve 122 to rotate in the direction of arrow 180 to the unlocked position 161' (FIG. 9) as the connector assembly 110 is moved over the sleeve 34 of female connector portion 12. When the connectors are fully engaged, the locking pins 30, 32 of the sleeve 34 of female connector 12 are engaged with the transverse pin stops (e.g., 190) of the respective locking pin engaging bosses 156, 158. The locking sleeve 122 also includes an integral tab 160 to allow the user (not shown) to release a locked connector assembly by moving the tab 160 in the direction of arrow 180 which rotates the locking sleeve 122 to the unlocked position 161'. See FIG. 9.

The locking sleeve 122 may be made from any of a wide variety of materials, such as metals or plastics, that would be suitable for the intended application. In one preferred embodiment, the locking sleeve is made from a single piece of glass-reinforced polyetherimide plastic, although other materials could also be used, as would be obvious to persons having ordinary skill in the art.

The locking sleeve 122 is biased in the locked position 161 (FIG. 9) by a spring 124 having a small tang end 125 which engages a hole (not shown) in the locking sleeve 122. See FIG. 8. The spring 124 may be retained within the top half 142 of the main connector body by any suitable device, such as a small cylindrically shaped post (not shown) sized to fit within the opening 127 of spring 124. The plain end 129 of spring 124 should be secured to the top half 142 of the main connector body. Essentially, then, the tang end 125 of spring 124 will move back and forth in the direction of arrows 181 as the locking sleeve 122 is moved back and forth between the locked and unlocked positions 161 and 161'.

It should be noted that a wide range of springs and other biasing devices well-known in the art could be used to bias the locking sleeve 122 in the locked position 161, as would be obvious to persons having ordinary skill in the art. Therefore, the present invention should not be regarded as limited to any one particular spring arrangement for biasing the locking sleeve 122.

This completes the detailed description of the preferred embodiments of the push-lock BNC connector according to the present invention. While a number of specific components were described above for the preferred embodiments of this invention, persons having ordinary skill in this art will readily recognize that other substitute components or combinations of components may be available now or in the future to accomplish comparable functions to the apparatus described herein. For example, while the present invention was shown and described herein as it could be used with "active" probe assemblies, it could be used just as easily with "passive" probe assemblies, in which case there would be no need for the optional contact pins 28 for conducting supplemental electrical currents or signals through the connector union. Further, even if the push-lock BNC connector 10 is used with such active probe assemblies, it is not necessary to arrange the contact pins 28 in the manner shown and described herein. Indeed, the contact pins could be arranged in any of an almost infinite number of configurations that may be necessary or desirable for a particular application.

Therefore, it is contemplated that the inventive concepts herein described may be variously otherwise embodied and it is intended that the appended claims be construed to include alternative embodiments of the invention except insofar as limited by the prior art.

What is claimed is:

1. A locking assembly for releasably locking together a mating connector pair, the mating connector pair including a first connector portion and a second connector portion, comprising:

a housing having a central aperture therethrough and a second aperture therethrough, said housing being adapted to be mounted to the first connector portion;

a locking sleeve having a central aperture therethrough sized to receive the first connector portion, said locking sleeve having a tab attached thereto wherein said tab extends through said housing second aperture, to manually rotate said locking sleeve said locking sleeve being adapted to be slidably received by the central aperture of said housing so that said locking sleeve can be rotated within said housing from a locked position to an unlocked position, said locking sleeve also including a locking pin engaging boss for releasably engaging a locking pin associated with the second connector portion, wherein said locking pin engaging boss rotates said locking sleeve to the unlocked position as the first connector portion is engaged with the second connector portion and allows the locking sleeve to be rotated to the locked position when the first and second connector portions are fully engaged; and a biasing device associated with said locking sleeve for biasing said locking sleeve in the locked position.

2. The locking assembly of claim 1, further comprising an alignment sleeve adapted to be received by the central aperture of said locking sleeve so that said alignment sleeve is positioned between said locking sleeve and the first connector portion, said alignment sleeve including an indexing slot for engaging the locking pin on said second connector portion so that said alignment sleeve is maintained in a fixed radial alignment with respect to said second connector portion when the locking pin is engaged with said indexing slot, said alignment sleeve being secured within said housing so that said alignment sleeve cannot rotate with respect to said housing.

3. The locking assembly of claim 2, wherein said housing includes an alignment tab extending radially inward from the central aperture and wherein said alignment sleeve includes a slot sized to engage the alignment tab wherein said alignment sleeve is prevented from rotating with respect to said housing.

4. The locking assembly of claim 1, wherein the locking pin engaging boss of said locking sleeve extends generally radially inward from the central aperture in said locking sleeve, the locking pin engaging boss having a ramp section and a pin stop section, said ramp section being generally axially oriented with respect to the central aperture and said pin stop section being generally transversely oriented with respect to the central aperture.

5. The locking assembly of claim 1, wherein said biasing device comprises a spring.

6. The locking assembly of claim 1, wherein said biasing device comprises a V-shaped member having a first leg and a second leg, the first leg being attached to said locking sleeve, the second leg being retained by said housing.

7. The locking assembly of claim 1, wherein said first connector portion is mounted to a main connector body and wherein said housing is mounted to said main connector body.

8. The locking assembly of claim 7, wherein said main connector body includes a plurality of connector pins for transmitting supplemental electrical signals.

9. A push-lock connector assembly for releasably engaging a female BNC connector, comprising:

a male BNC center terminal; and a locking assembly associated with said male BNC center terminal, said locking assembly including:

a housing having a central aperture therethrough and a second aperture therethrough, said housing being adapted to be mounted to said male BNC center terminal;

a locking sleeve having a central aperture therethrough sized to receive said male BNC center terminal, said locking sleeve having a tab attached thereto wherein said tab extends through said housing second aperture, to manually rotate said locking sleeve said locking sleeve being adapted to be slidably received by the central aperture of said housing so that said locking sleeve can be rotated within said housing from a locked position to an unlocked position, said locking sleeve also including a locking pin engaging boss for releasably engaging a locking pin associated with the female BNC connector, wherein said locking pin engaging boss rotates said locking sleeve to the unlocked position as said push-lock connector assembly is engaged with the female BNC connector and allows the locking sleeve to be rotated to the locked position when said male BNC center terminal and the female BNC connector are fully engaged; and a biasing device associated with said locking sleeve for biasing said locking sleeve in the locked position.

10. The push-lock connector assembly of claim 9, further comprising an alignment sleeve adapted to be received by the central aperture of said locking sleeve so that said alignment sleeve is positioned between said locking sleeve and said male BNC center terminal, said alignment sleeve including and indexing slot for engaging the locking pin on the female BNC connector so that said alignment sleeve is maintained in a fixed radial alignment with respect to the female BNC connector when the locking pin is engaged with said indexing slot, said alignment sleeve being secured within said housing so that said alignment sleeve cannot rotate with respect to said housing.

11. The push-lock connector assembly of claim 10, wherein said housing includes an alignment tab extending radially inward from the central aperture and wherein said alignment sleeve includes a slot sized to engage the alignment tab wherein said alignment sleeve is prevented from rotating with respect to said housing.

12. The locking assembly of claim 9, wherein the locking pin engaging boss of said locking sleeve extends generally radially inward from the central aperture in said locking sleeve, the locking pin engaging boss having a ramp section and a pin stop section, said ramp section being generally axially oriented with respect to the central aperture and said pin stop section being generally transversely oriented with respect to the central aperture.

13. The push-lock connector assembly of claim 9, wherein said biasing device comprises a spring.

* * * * *